United States Patent [19]

Woodford et al.

[11] 4,406,858

[45] Sep. 27, 1983

[54] COPPER-BASE ALLOYS CONTAINING STRENGTHENING AND DUCTILIZING AMOUNTS OF HAFNIUM AND ZIRCONIUM AND METHOD

[75] Inventors: David A. Woodford; Rodger H. Bricknell, both of Schenectady, N.Y.

[73] Assignee: General Electric Company, Schenectady, N.Y.

[21] Appl. No.: 335,901

[22] Filed: Dec. 30, 1981

[51] Int. Cl.[3] ..... C22C 9/00

[52] U.S. Cl. ..... 420/475; 420/486; 420/487; 420/488; 420/492

[58] Field of Search ..... 75/153; 420/492, 475, 420/486, 487, 488

[56] References Cited

U.S. PATENT DOCUMENTS 2,830,898 4/1958 Gwyn, Jr. ..... 75/153

3,019,102 1/1962 Saarivirta ..... 75/153

3,330,653 7/1967 Paces et al. ..... 75/153

3,392,016 7/1968 Opie et al. ..... 75/153

FOREIGN PATENT DOCUMENTS 54-104597 8/1979 Japan ..... 420/492

OTHER PUBLICATIONS

Copper Abstracts, "Hafnium as an Alloying Element in Copper, Iron and Nickel", No. 1685, Oct. 1960, p. 9.

*Primary Examiner*—Peter K. Skiff

*Attorney, Agent, or Firm*—Leo I. MaLossi; James C. Davis, Jr.; James Magee, Jr.

[57] ABSTRACT

Tensile strength and ductility of copper-base alloys having poor intermediate temperature range ductility are substantially increased by relatively small alloying additions of hafnium or zirconium.

10 Claims, 2 Drawing Figures

COPPER-BASE ALLOYS CONTAINING STRENGTHENING AND DUCTILIZING AMOUNTS OF HAFNIUM AND ZIRCONIUM AND METHOD

FIELD OF THE INVENTION

The present invention relates generally to copper and its alloys, and is more particularly concerned with novel copper-base alloys containing relatively small alloying additions of hafnium or zirconium, or both, and consequently having substantially increased tensile strength and ductility, particularly intermediate temperature range tensile ductility, and with a new method of producing those alloys.

BACKGROUND OF THE INVENTION

Many copper alloys have poor intermediate temperature range (i.e., between about 300° and about 700° C.) tensile ductility which may lead to premature failure in service or to reheat cracking following welding. General recognition of such shortcomings has stimulated attempts by others to solve the problem with the result that various alloys have been developed to optimize strength and ductility properties. In one such instance directed to cast copper alloys for marine applications, where repair welding without reheat cracking is vitally important, the optimized copper-base alloy contained 13% nickel, 2% iron, 5% manganese and 3% aluminum. That alloy, however, may not prove to be a satisfactory answer to the problem for although the manganese addition improves the high strain rate hot ductility of the alloy, it does so at the expense of room temperature strength. Also, the intermediate temperature range tensile ductility is still very poor which may limit weldability. In addition, other copper-nickel alloys, for example, for condenser tube use in which reliability depends importantly upon both strength and ductility, may not always meet the needs of plant designers.

SUMMARY OF THE INVENTION

This invention, based upon our discoveries set out below, opens the way to the goal of providing copper-base alloys having special utility in a wide range of applications including those requiring superior mechanical properties at elevated temperatures. More particularly, the new alloys of this invention have a unique combination of substantial tensile ductility, particularly in the intermediate temperature range, and high tensile strength after casting and after heat treatments such as a 50 hour anneal at 800° C. Further, the strength and ductility improvements extend across the entire temperature range from room temperature to about 700° C. and ductility is superior up to about 900° C.

These important new results are achieved through the application of our discoveries that hafnium and zirconium have the effect of ductilizing and strengthening copper-base alloys. We believe that hafnium and zirconium in combination should also be effective in imparting the benefits of our invention. In broad general terms then, the new alloys of this invention are of the copper-base type wherein zirconium or hafnium or both of these metals are used in total amount from about 0.1% to 5.0% of the alloy and have substantially increased tensile strength and ductility, particularly intermediate temperature range tensile ductility, compared to substantially the same copper-base alloy without the hafnium and/or zirconium additions of this invention in both the as-cast and as-annealed conditions. Further, we have found that between about 1.5% and about 3.0% are the optimum amounts of hafnium in the new alloy products of this invention. Zirconium, in the range of from about 0.1 to about 1.0%, may alternatively be used to gain the benefits of the invention.

In similar broad fashion, the method of the invention of substantially increasing both the strength and the tensile ductility of copper-base alloys comprises the step of adding to the alloy an alloying constituent selected from the group consisting of hafnium and zirconium and mixtures thereof in an amount of from about 0.1% to about 5.0%

BRIEF DESCRIPTION OF THE DRAWINGS

The invention will be more clearly understood from the detailed description to follow in conjunction with the following drawings wherein.

DETAILED DESCRIPTION OF THE INVENTION

Figure 1:
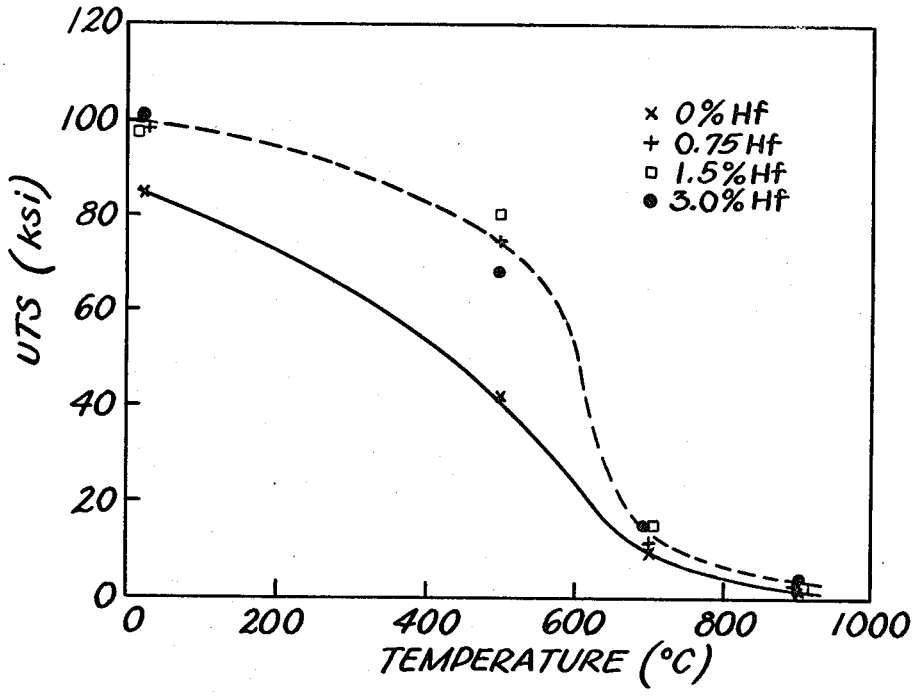
FIG. 1 is a graph showing the effect on the ultimate tensile strength of relatively small alloying additions of hafnium to a prior art copper-base alloy versus testing temperature.

In the mid temperature range, the aforesaid optimized copper-nickel alloy of the prior art was found to have attractive properties at high strain rates (i.e., greater than about $10^1$ per second) as measured on a "Gleeble" apparatus as reported by J. P. Chubb et al. in the article "Effect of Alloying and Residual Elements on Strength and Hot Ductility of Cast Cupro-Nickel" which appears at pp. 20–25 of Vol. 30 (#3) of the March 1978 edition of the *Journal of Metals* and which is incorporated herein by reference. The aforesaid optimized alloy was, however, subsequently found by us to be brittle in the intermediate temperature range by conventional tensile tests (i.e., strain rates on the order of about $10^{-5}$ to about $10^{-2}$ per second). We discovered, however, that relatively small alloying additions of hafnium or zirconium were effective to substantially increase the tensile strength and ductility, particularly the tensile ductility in the intermediate temperature range, of the aforesaid optimized prior art alloy in particular and copper-base alloys in general.

The novelty and special merits of this invention were demonstrated in an experiment in which the effects of additions of the alloying elements boron and hafnium on the mechanical properties of a copper-nickel alloy were compared with each other and with the optimized alloy of the prior art, Cu-13Ni-2Fe-5Mn-3Al, i.e., Cu-Ni(OPT). The alloys designated Cu-Ni(OPT) Cu-Ni(OPT)-0.1B and Cu-Ni(OPT)-1.5Hf in Table I below were cast into graphite molds and machined to tensile specimens of standard size and shape to be tested over a range of temperature. Each specimen was initially exposed to 800° C. for 50 hours either in air or in vacuum ($10^{-5}$ torr) prior to testing. The results developed in the course of these tests are set forth in Table I.

TABLE I

| Exposure | Temp. °C. | $YS_{psi}$ | $TS_{psi}$ | Eml % | $El_f$ % | RA % |
|---|---|---|---|---|---|---|
| Cu—Ni (OPT) | A RT | 69100 | 88300 | 8.8 | 9.3 | 7.2 |
| | B 500 | — | 52400 | 0 | 0 | 0 |
| 50 hrs 800° C. | C 700 | 9400 | 9400 | 0.2 | 27.6 | 40.1 |
| Air | D 900 | 2234 | 2684 | 11.3 | 45.2 | 33.1 |
| 50 hrs 800° C. | E RT | 70200 | 84900 | 6.5 | 8.7 | 18.7 |
| Vac | F 500 | — | 42000 | 0 | 0 | 0 |
| | G 700 | 9220 | 9537 | 1.6 | 25.2 | 19.6 |
| | H 900 | 2228 | 2367 | 4.0 | 46.9 | 48.5 |
| Cu—Ni (OPT)-0.1B | A RT | 77000 | 104800 | 15.4 | 15.7 | 20.9 |
| 50 hrs 800°0 C. | B 500 | — | 58900 | 0 | 0 | 0 |
| Air | C 700 | 9210 | 9285 | 1.3 | 37 | 22.4 |
| | D 900 | 2717 | 2717 | 0.2 | 43.8 | 43.7 |
| 50 hrs 800° C. | E RT | 76300 | 98500 | 7 | 8 | 13.4 |
| Vac | F 500 | — | 46900 | 0 | 0 | 0 |
| | G 700 | 9192 | 9317 | 2.0 | 35.8 | 29.0 |
| | H 900 | 2589 | 2614 | 0.6 | 44.6 | 25.7 |
| Cu—Ni (OPT)-1.5Hf | A RT | 69200 | 97900 | 11.4 | 15.2 | 20.4 |
| 50 hrs 800° C. | B 500 | 68500 | 77300 | 1.2 | 1.6 | 3.7 |
| Air | C 700 | 13700 | 14600 | 5.1 | 38.3 | 86.5 |
| | D 900 | 2719 | 2995 | 1.1 | 70.8 | 97.8 |
| 50 hrs 800° C. | E RT | 70700 | 97900 | 13.4 | 14.5 | 5.7 |
| Vac | F 500 | 72900 | 80200 | 1.8 | 1.8 | 6.2 |
| | G 700 | 13800 | 15300 | 4.8 | 45.4 | 44.8 |
| | H 900 | 2960 | 3064 | 2.7 | 55.7 | 97.8 |

Cu—Ni (OPT) = Cu—13Ni—2Fe—5Mn—3Al
$YS_{psi}$ = Yield strength-pounds per square inch (0.2% offset)
$TS_{psi}$ = Tensile strength-pounds per square inch
Eml % = Percent elongation to maximum load
$El_f$% = Percent elongation to failure
RA % = Percent reduction in area
RT = Room temperature
Vac = Anneal at $10^{-5}$ torr The addition of 1.5% hafnium to the prior art alloy was found by us to be very effective in improving tensile ductility and, at the same time, appreciably increased the strength of the alloy, particularly the tensile strength, at all temperatures. Boron, on the other hand, did not improve the tensile ductility at any temperature although it did increase the strength of the alloy at room temperature by about 10%. No differences were detected following exposure of the alloys of Table I to the air and vacuum environments; thus, it was concluded that there was no embrittlement due to oxygen penetration.

In another similar experiment, the same prior art optimized alloy was used in testing the effects of various amounts of hafnium on the strength and ductility of the alloy. As above, various heats were cast into graphite molds, machined to tensile specimens and annealed for 50 hours at 800° C. in vacuum ($10^{-5}$ torr) prior to mechanical testing on an Instron machine at a strain rate of $7\times10^{-4}$ per second. The resulting test data are set out in Table II and FIGS. 1 and 2.

TABLE II

| Alloy | T °C. | $YS_{psi}$ | $TS_{psi}$ | $El_f$% | RA % |
|---|---|---|---|---|---|
| Cu—Ni (OPT) | RT | 70200 | 84900 | 8.7 | 18.7 |
| Cu—Ni.75Hf | " | 63500 | 98600 | 13.8 | 17.7 |
| Cu—Ni—1.5Hf | " | 70700 | 97900 | 14.5 | 23 |
| Cu—Ni—3Hf | " | 69500 | 101100 | 15.4 | 14 |
| Cu—Ni (OPT) | 500 | — | 42000 | 0 | 0 |
| Cu—Ni—.75HF | " | — | 75000 | 0.2 | 6.8 |
| Cu—Ni—1.5HF | " | 72900 | 80200 | 1.8 | 6.2 |
| Cu—Ni—3HF | " | 57600 | 68500 | 4.2 | 12.5 |
| Cu—Ni (OPT) | 700 | 9200 | 9537 | 25.2 | 19.6 |
| Cu—Ni—.75Hf | " | 12200 | 12400 | 42.1 | 45 |
| Cu—Ni—1.5Hf | " | 13800 | 15300 | 54 | 44.8 |
| Cu—Ni—3Hf | " | 12600 | 15000 | 33.9 | 67 |
| Cu—Ni (OPT) | 900 | 2230 | 2367 | 46.9 | 48.5 |
| Cu—Ni—.75Hf | " | 3114 | 3139 | 71.6 | 97.8 |

TABLE II-continued

| Alloy | T °C. | $YS_{psi}$ | $TS_{psi}$ | $El_f$% | RA % |
|---|---|---|---|---|---|
| Cu—Ni—1.5Hf | " | 2960 | 3064 | 55.7 | 97.8 |
| Cu—Ni—3Hf | " | 3470 | 3932 | 50.4 | 99.4 |

Symbols and abbreviations as in Table I.

TABLE III

| Alloy | T °C. | $YS_{psi}$ | $TS_{psi}$ | $El_f$% | RA % |
|---|---|---|---|---|---|
| Cu—Ni (OPT) | RT | 36500 | 67400 | 40.2 | 46.1 |
| Cu—Ni—.3 Zr | | 41100 | 73900 | 42.7 | 36.6 |
| Cu—Ni (OPT) | 300 | 37800 | 62900 | 42.4 | 39.2 |
| Cu—Ni—.3 Zr | | 39100 | 60300 | 29 | 32.2 |
| Cu—Ni (OPT) | 500 | 40400 | 40800 | 0.4 | 4.7 |
| Cu—Ni—.3 Zr | | 51100 | 57400 | 4.3 | 9.1 |
| Cu—Ni (OPT) | 700 | 11000 | 11900 | 13.1 | 18.7 |
| Cu—Ni.3 Zr | | 11700 | 13700 | 33.4 | 27.5 |

Symbols and abbreviations as in Table I.

Figure 2:
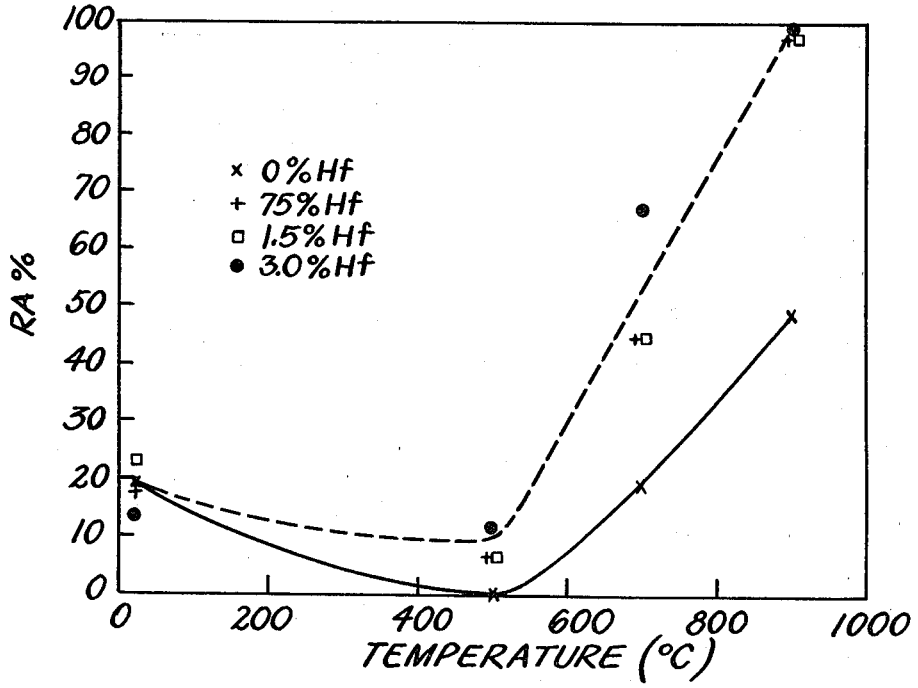
FIG. 2 is a graph showing the effect on the percent reduction in area of additions of relatively small alloying additions of hafnium to the prior art alloy of FIG. 1 versus testing temperature.

The data of Table II show that hafnium in various amounts was effective in increasing the elevated temperature yield and tensile strengths of the prior art optimized alloy. As shown in FIG. 1, the tensile strength of the alloys within the scope of the invention was also increased at room temperature over that of the prior art optimized alloy. The improvement in tensile strength was most pronounced at about 500° C. and persisted to about 900° C. although diminished in magnitude. Similarly, hafnium in various amounts was effective in improving the elevated temperature tensile ductility as measured by elongation to fracture and percent reduction in area and the room temperature elongation to fracture. As shown in FIG. 2, the tensile ductility of the prior art optimized alloy decreases rapidly above room temperature and decreases to zero at about the middle of the intermediate temperature range before recovering. The copper-base alloys within the scope of the invention exhibit enhanced tensile ductility at elevated temperatures, compared to the optimized prior art alloy, particularly in the intermediate temperature range and especially at the temperature at which the prior art optimized alloy exhibited zero ductility.

While the optimum effect of hafnium in increasing strength and ductility was obtained at about 1.5%, the Table II data reveal significant increases in both properties over the entire temperature range to 900° C. as a result of hafnium additions of 0.75 to 3.0%. Thus, indication is given that lesser and greater amounts of hafnium up to about 5% can be employed to advantage in accordance with this invention.

In still another similar experiment, the effect of zirconium was investigated. The resulting data obtained for the as-cast alloy (i.e., the optimized alloy without anneal at 800° C.) are set out in Table III.

The zirconium addition substantially improves both ductility and strength at 500° C., at which temperature the prior art alloy exhibited the minimum measured ductility, thus giving indication that greater or perhaps lesser amounts of zirconium may be even more beneficial.

The beneficial effect of hafnium on strength and ductility of a leaded tin bronze used in steam valve bodies and high duty bearings was tested in another similar experiment in which melts with and without hafnium additions were cast in graphite molds of the same size and shape as those used in the experiments described above. Tensile strength and ductility of the cast bodies, without annealing treatment, were measured with the results set forth in Table IV.

TABLE IV

EFFECT OF HAFNIUM ON THE PROPERTIES OF A LEADED TIN BRONZE

| Alloy | T °C. | $YS_{psi}$ | $TS_{psi}$ | $El_f$ % | RA % |
|---|---|---|---|---|---|
| Base | RT | 20 | 43.4 | 26.9 | 33 |
| Base + 2% Hf | " | 23.9 | 46.7 | 16 | 14.9 |
| Base | 300 | 19.3 | 35.5 | 13.4 | 16.2 |
| Base + 2% Hf | " | 21.8 | 43.7 | 12.4 | 10.8 |
| Base | 500 | 17 | 18.5 | 4.7 | 4.9 |
| Base + 2% Hf | " | 19.5 | 22.4 | 24 | 26.8 |

Symbols and abbreviations as in Table I.

The leaded tin bronze alloy (base alloy) used in this experiment had the following approximate composition:

| | Percent |
|---|---|
| Copper | 89 |
| Tin | 6 |
| Lead | 1.5 |
| Zinc | 4.5 |
| Nickel | 0.75 |
| Iron | 0.20 |
| Antimony | 0.20 |
| Sulfur | 0.05 |
| Silicon | 0.005 |
| Phosphorous | 0.02 |

Tensile strength increases between 8% and 23% are evident as a consequence of hafnium additions of 2%. Again, the most dramatic effect on tensile ductility was obtained at 500° C. where $El_f$ and RA were increased by about a factor of five compared with the prior art alloy not having hafnium.

The new alloys of this invention can be prepared in any convenient manner and without the necessity for special equipment or conditions beyond those used in general practice at the present time. Our preference, as previously indicated, is to add metallic hafnium or zirconium in convenient form to a melt of copper-base alloy. Alternatively, the hafnium or zirconium may be addd in the form of master alloys. The melt is thereafter cast and articles of the resulting alloy of desired form and size are fabricated in suitable conventional manner. No special procedure or equipment is necessary for such purposes beyond that employed in normal preparation of the corresponding copper-base alloys of the prior art.

In the specification and appended claims, wherever percentage or proportion is stated, reference is to the weight basis.

What is claimed is:

1. A copper-base alloy containing from about 0.1 to about 5.0 weight percent of an alloying element selected from the group consisting of hafnium and zirconium, said copper-base alloy having substantially increased strength and tensile ductility, particularly intermediate temperature range tensile ductility, compared to substantially the same copper-base alloy without said alloying element, said copper-base alloy without said alloying element being subject to low or nil intermediate temperature range tensile ductility, said copper-base alloy without said alloying element being a leaded tin bronze consisting essentially of about, by weight, 6% Sn, 1.5% Pb, 4.5% Zn, 0.75% Ni, 0.20% Fe, 0.20% Sb, 0.05% S, 0.005% Si, 0.02% P, the balance copper.

2. The copper-base alloy of claim 1 containing from about 1.5 to about 3.0 weight percent hafnium.

3. The copper-base alloy of claim 1 containing from about 0.1 to about 1.0 weight percent zirconium.

4. A copper-base alloy containing from about 0.1 to about 5.0 weight percent of an alloying element selected from the group consisting of hafnium and zirconium, said copper-base alloy having substantially increased strength and tensile ductility, particularly intermediate temperature range tensile ductility, compared to substantially the same copper-base alloy without said alloying element, said copper-base alloy without said alloying element being subject to low or nil intermediate temperature range tensile ductility, said copper-base alloy without said alloying element consisting essentially of about, by weight, 13% Ni, 2% Fe, 5% Mn, 3% Al, the balance copper.

5. The alloy of claim 4 containing from about 1.5 to about 3.0 weight percent hafnium.

6. The alloy of claim 4 containing from about 0.1 to about 1.0 weight percent zirconium.

7. The method of substantially increasing both the strength and tensile ductility, particularly the intermediate temperature range tensile ductility, of copper-base alloys subject to low or nil intermediate temperature range tensile ductility, which comprises the step of adding to the melt of such copper-base alloys an amount of an alloying element selected from the group consisting of hafnium and zirconium sufficient to result in the presence of from about 0.1 to about 5.0 weight percent of the selected alloying element in the solidified alloy, said copper-base alloy without said alloying element consisting essentially of about, by weight, 13% Ni, 2% Fe, 5% Mn, 3% Al, the balance copper.

8. The method of claim 7 wherein the step comprises adding sufficient hafnium to result in the presence of from about 1.5 to about 3.0 weight percent hafnium in the solidified alloy.

9. The method of claim 7 wherein the step comprises adding sufficient zirconium to result in the presence of from about 0.1 to about 1.0 weight percent zirconium in the solidified alloy.

10. The method of substantially increasing both the strength and tensile ductility, particularly the intermediate temperature range tensile ductility, of copper-base alloys subject to low or nil intermediate temperature range tensile ductility, which comprises the step of adding to the melt of such copper-base alloys an amount of an alloying element selected from the group consisting of hafnium and zirconium sufficient to result in the presence of from about 0.1 to about 5.0 weight percent of the selected alloying element in the solidified alloy, said copper-base alloy without said alloying element being a leaded tin bronze consisting essentially of about, by weight, 6% Sn, 1.5% Pb, 4.5% Zn, 0.75% Ni, 0.20% Fe, 0.20% Sb, 0.05% S, 0.005% Si, 0.02% P, the balance copper.

* * * * *